US008919426B2

(12) United States Patent
Hardesty

(10) Patent No.: US 8,919,426 B2
(45) Date of Patent: Dec. 30, 2014

(54) MICRO-CHANNEL PULSATING HEAT PIPE

(75) Inventor: Robert E. Hardesty, Danville, CA (US)

(73) Assignee: The Peregrine Falcon Corporation, Pleasanton, CA (US)

( * ) Notice: Subject to any disclaimer, the term of this patent is extended or adjusted under 35 U.S.C. 154(b) by 1896 days.

(21) Appl. No.: 11/876,610

(22) Filed: Oct. 22, 2007

(65) Prior Publication Data

US 2009/0101308 A1 Apr. 23, 2009

(51) Int. Cl.
*F28D 1/03* (2006.01)
*F28D 15/02* (2006.01)

(52) U.S. Cl.
CPC ..... *F28D 1/035* (2013.01); *F28D 15/0233* (2013.01); *F28D 15/0266* (2013.01); *F28F 2210/02* (2013.01); *F28F 2210/10* (2013.01)
USPC ..... 165/104.21; 165/104.26; 165/104.29; 165/104.33

(58) Field of Classification Search
CPC ..... F28D 15/0266; F28D 15/0233; F28D 15/046; H01L 23/427
USPC ..... 165/104.21, 104.26, 104.29, 104.33
See application file for complete search history.

(56) References Cited

U.S. PATENT DOCUMENTS 1,808,617 A * 6/1931 Thompson ..... 165/104.33
3,143,592 A * 8/1964 August ..... 165/104.21
4,053,942 A * 10/1977 Dougherty et al. ..... 165/104.29
4,452,051 A * 6/1984 Berger et al. ..... 165/104.11
4,602,679 A * 7/1986 Edelstein et al. ..... 165/104.26
4,712,158 A * 12/1987 Kikuchi et al. ..... 361/699
4,884,169 A * 11/1989 Cutchaw ..... 361/700
4,921,041 A * 5/1990 Akachi ..... 165/104.29
4,931,905 A * 6/1990 Cirrito et al. ..... 165/104.33
4,948,965 A 8/1990 Feller
5,033,539 A * 7/1991 Kohtaka ..... 165/104.21
5,142,441 A 8/1992 Seibold et al.
5,179,500 A * 1/1993 Koubek et al. ..... 165/104.33
5,203,399 A * 4/1993 Koizumi ..... 165/104.33
5,219,020 A * 6/1993 Akachi ..... 165/104.26
5,285,347 A * 2/1994 Fox et al. ..... 361/699
5,303,768 A * 4/1994 Alario et al. ..... 165/104.26
5,333,470 A * 8/1994 Dinh ..... 165/104.14
5,394,936 A * 3/1995 Budelman ..... 165/104.33
5,404,938 A * 4/1995 Dinh ..... 165/104.14

(Continued)

OTHER PUBLICATIONS

R.R. Riehl, "Characteristics of an Open Loop Pulsating Heat Pipe", SAE Int'l, Nat'l Institute for Space Research—INPE/DMC/Satellite, paper No. 2004-01-2509, 2004, 8 pages.

(Continued)

*Primary Examiner* — Ljiljana Ciric
(74) *Attorney, Agent, or Firm* — Thomas Schneck

(57) ABSTRACT

A heat pipe device and a corresponding method in which micro-channel embedded pulsating heat pipes are incorporated into a substrate. A volume of fluid in a vacuum is introduced into a micro-channel which will become slugs of liquid. Heating of the contents of the micro-channel at an evaporator region (heat source) will cause vaporization within the micro-channel and cooling at a heat sink will cause condensation within the micro-channel, acting to both drive fluid flow within the micro-channel and efficiently transfer heat. Such devices could be used in a number of different configurations, including one as a stacked set of micro-channel embedded substrates.

13 Claims, 9 Drawing Sheets

(56) References Cited

U.S. PATENT DOCUMENTS

| | | | | |
|---|---|---|---|---|
| 5,490,558 | A * | 2/1996 | Akachi | 165/104.33 |
| 5,611,214 | A | 3/1997 | Wegeng et al. | |
| 5,642,775 | A * | 7/1997 | Akachi | 165/104.21 |
| 5,697,428 | A * | 12/1997 | Akachi | 165/104.21 |
| 5,725,049 | A * | 3/1998 | Swanson et al. | 165/104.26 |
| 5,845,702 | A * | 12/1998 | Dinh | 165/104.21 |
| 5,921,315 | A * | 7/1999 | Dinh | 165/104.21 |
| 5,924,479 | A * | 7/1999 | Egbert | 165/104.14 |
| 5,940,270 | A * | 8/1999 | Puckett | 165/104.33 |
| 6,026,890 | A * | 2/2000 | Akachi | 165/104.26 |
| 6,056,044 | A * | 5/2000 | Benson et al. | 165/104.26 |
| 6,137,682 | A * | 10/2000 | Ishimine et al. | 165/104.21 |
| 6,164,368 | A * | 12/2000 | Furukawa et al. | 165/104.33 |
| 6,173,759 | B1 * | 1/2001 | Galyon et al. | 361/699 |
| 6,269,865 | B1 * | 8/2001 | Huang | 165/104.26 |
| 6,333,849 | B1 * | 12/2001 | Donahoe et al. | 361/699 |
| 6,388,882 | B1 * | 5/2002 | Hoover et al. | 165/104.33 |
| 6,457,515 | B1 | 10/2002 | Vafai et al. | |
| 6,496,367 | B2 * | 12/2002 | Donahoe et al. | 361/699 |
| 6,510,053 | B1 | 1/2003 | Azar | |
| 6,530,420 | B1 * | 3/2003 | Takada et al. | 165/104.33 |
| 6,591,902 | B1 * | 7/2003 | Trent | 165/104.21 |
| 6,661,658 | B2 * | 12/2003 | Capriz et al. | 165/104.33 |
| 6,672,373 | B2 * | 1/2004 | Smyrnov | 165/104.26 |
| 6,679,316 | B1 * | 1/2004 | Lin et al. | 165/104.26 |
| 6,714,412 | B1 * | 3/2004 | Chu et al. | 361/699 |
| 6,751,095 | B2 * | 6/2004 | Ishikawa et al. | 165/104.33 |
| 6,788,537 | B2 | 9/2004 | Saita et al. | |
| 6,809,927 | B2 * | 10/2004 | Minamitani et al. | 361/699 |
| 6,840,310 | B2 * | 1/2005 | Tonosaki et al. | 165/104.21 |
| 6,856,037 | B2 * | 2/2005 | Yazawa et al. | 361/699 |
| 6,966,359 | B1 * | 11/2005 | Liu | 165/104.21 |
| 6,989,134 | B2 | 1/2006 | Tonkovich et al. | |
| 6,999,559 | B2 * | 2/2006 | Geitz | 378/141 |
| 7,059,391 | B2 * | 6/2006 | Whitney | 165/104.33 |
| 7,080,681 | B2 * | 7/2006 | Wert | 165/104.21 |
| 7,256,999 | B1 * | 8/2007 | Heady | 165/104.33 |
| 7,345,877 | B2 * | 3/2008 | Asfia et al. | 165/104.33 |
| 7,411,790 | B2 * | 8/2008 | Huang | 165/104.33 |
| 7,434,308 | B2 * | 10/2008 | Lu et al. | 29/830 |
| 7,480,992 | B2 * | 1/2009 | Okamoto et al. | 29/890.054 |
| 7,856,711 | B2 * | 12/2010 | Lu et al. | 29/830 |
| 7,888,603 | B2 * | 2/2011 | Lu et al. | 361/792 |
| 8,107,241 | B2 * | 1/2012 | Takahashi et al. | 165/104.33 |
| 8,109,324 | B2 * | 2/2012 | Farid et al. | 165/104.33 |
| 2002/0135980 | A1 | 9/2002 | Vafai | |
| 2005/0263273 | A1 | 12/2005 | Crumly | |
| 2006/0113063 | A1 | 6/2006 | Chordia et al. | |

OTHER PUBLICATIONS

S. Khandekar et al., "An Introduction to Pulsating Heat Pipes", Electronics Cooling, University of Stuttgart, vol. 9, No. 2, May 2003, pp. 38-41.

S. Khandekar et al., "Understanding Operational Regimes of Closed Loop Pulsating Heat Pipes: An Experimental Study", Applied Thermal Engineering, Elsevier Science, vol. 23, No. 6, pp. 707-719.

P. Charoensawan et al., "Closed Loop Pulsating Heat Pipes: Part A: Parametric Experimental Investigations", Applied Thermal Engineering, Elsevier Science, 2003, 14 pages.

S. Khandekar et al., "Pulsating Heat Pipes: Study on a Two-Phase Loop", 13th Int'l Conference on Thermal Engineering and Thermogrammetry (THERMO), Jun. 18-20, 2003, 8 pages.

M.B. Shafii et al., "Thermal Modeling of Unlooped and Looped Pulsating Heat Pipes", Journal of Heat Transfer, vol. 123, Issue 6, Dec. 2001, pp. 1159-1172.

S. Liu et al., "Experimental Study of Flow Patterns and Improved Configurations for Pulsating Heat Pipes", Journal of Thermal Science, vol. 16, No. 1, Oct. 2006, pp. 56-62.

G. Karimi et al., "Review and Assessment of Pulsating Heat Pipe Mechanism for High Heat Flux Electronic Cooling", 2004 Inter Society Conference on Thermal Phenomena, IEEE, 2004, pp. 52-59.

* cited by examiner

MICRO-CHANNEL PULSATING HEAT PIPE

TECHNICAL FIELD

The present invention relates to heat removing devices and methods and more specifically to a pulsating heat pipe devices and related methods.

BACKGROUND

Heat removal has become essential for the proper performance of high density microelectronics, optical devices, instrumentation and other devices. One field where heat removal may be especially critical is aerospace. All satellites, space borne vehicles and avionics depend upon their thermal control systems to allow the instruments, communication systems, power systems and other electronic devices to operate within a specified temperature range. In simplest terms, cooling is provided by conductance of thermal energy away from warm sources into radiators or heat exchangers and then dispersed.

In satellite applications, cooling is typically performed by simple conductance from the warm source into a conduction plane, through a mounting interface, into a heat pipe and then into a radiator and radiated into space.

The increasing use of high-performance, space borne instruments, electronics and communication systems result in the need to dissipate much larger thermal loads while meeting demanding weight and size constraints. In addition, tight temperature control is also required for optical alignment needs, lasers, and detectors. Further the drive for miniaturization with micro electro-mechanical systems increases the pressure to develop efficient thermal regulation systems. This creates an environment demanding an efficient thermal control solution. One proposed thermal regulation system is heat pipe systems. Pulsating heat pipes have been produced on a laboratory scale from small diameter bent tubing, as illustrated in FIG. 1.

Pulsating heat pipes are passive thermal control devices, employing a heat source evaporation section and a heat sink condensation section of the pipe to effect a two-phase heat pipe. Pulsating heat pipes have consisted of one or more capillary dimension tubes bent into a curving structure to form parallel or interwoven structures. For example, FIG. 1 shows a device having tube sections 1, having end bends 2. The tube sections are mounted on a plate 3, having mounting holes 4 allowing the plate to be secured onto a fixed location. Plate surface 5 and/or exposed tubes on the end of plate 5 will absorb heat from the heat source, causing evaporation of some of the liquid within the tubes 1 and driving fluid flow. At bends 2, heat is transferred (e.g., by radiation or convection) allowing this part of the device to act as a heat sink. Liquid within the tubes condenses at the heat sink, further driving fluid flow. The vapor "pulses" generated by the heat source and at least partially condense at a heat sink condensation region. The use of a looped structure allows evaporation and condensation at "bend" locations along the length of the pipe, providing greater surface area for heat to be absorbed or radiated.

FIG. 1 is a reproduction of a Kenzan fin pulsating heat pipe. In one example the base plate is 80 mm square and 2 mm thick, with a 450 Watt heat through put capacity and a thermal resistance of 0.089° C./W. The tubing has an interior diameter of 1.2 mm, with the pipe making 500 turns.

Presently pulsating heat pipe devices such as those shown in FIG. 1 have been generally described as separate functioning device uncoupled from the entire system. These laboratory scale pulsating heat pipes have generally been produced from bent tubing. They have demonstrated the performance of a pulsating heat pipe but have a number of drawbacks, including that these devices are difficult to mount effectively to hardware, difficult to manufacture, and relatively fragile.

SUMMARY

Our object is to apply micro-fabrication technology to embed heat pipes into a robust, solid state structure that is able to withstand mechanical forces, and still greatly improves the thermal conductivity of the material.

It is a further object to improve pulsating heat pipe performance by allowing smaller diameter tubing (<1.13 mm dia.), more bends/turns, greater densities per given volume and the formation of a more precise and mass production oriented fabrication process.

DETAILED DESCRIPTION

Figure 1:
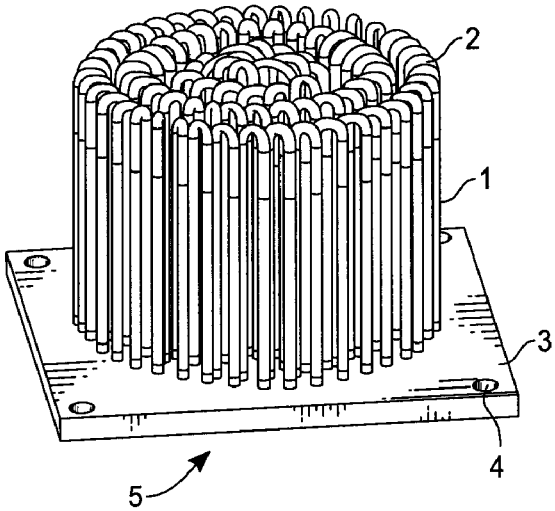
Fig. 1 (Prior Art)
FIG. 1 is a top perspective view of a prior art, experimental heat pipe.
Figure 2:
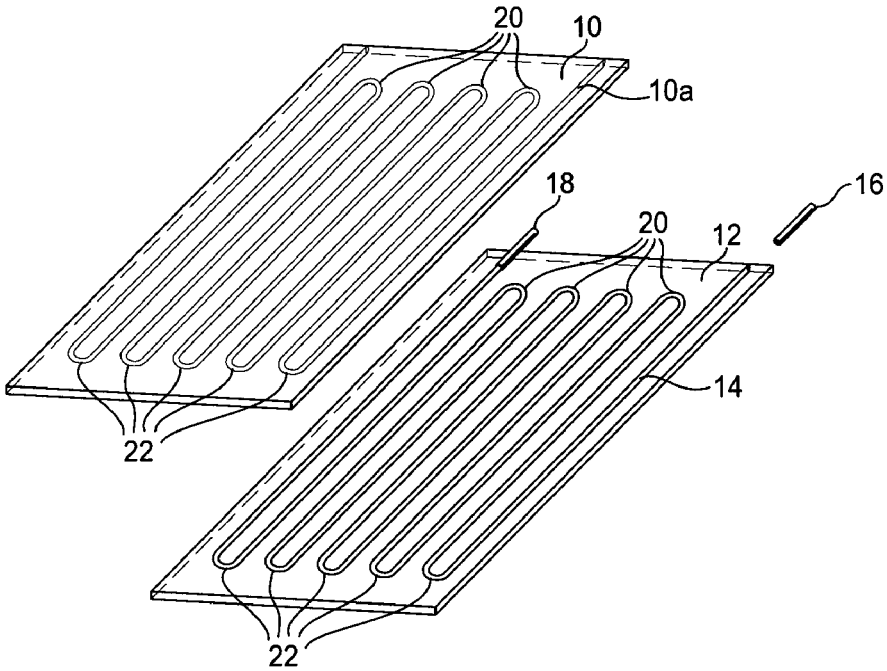
FIG. 2 is a top perspective exploded view of an embodiment of the present heat pipe.

With reference to FIG. 2, the exploded view shows a top substrate 10 and a bottom substrate 20. On the bottom side of top substrate 10 is a serpentine micro-channel trace 10*a*, that matches to a serpentine micro-channel trace 14 on the bottom layer 12. When the top layer 10 and the bottom layer 12 are affixed together (as by thermal bonding) serpentine micro-channel traces 10*a*, 14 become a single serpentine micro-channel. The micro-channel has a first edge bends 20 on one edge of the bonded layers and a second edge bends 22 on an opposite edge. These bends may act as the evaporator and condenser area respectively. A liquid may be introduced into the micro-channel through fill tubes 16, 18. Fill tube 16 is shown removed from the micro-channel and fill tube 18 is shown inserted into the micro-channel. The micro-channels are evacuated to a vacuum by connecting a vacuum pump to the pinch tubes. Once evacuated a working fluid is introduced to partially fill the micro-channel. Once filled to the designed level, the pinch tubes are pinched off separating the micro-channel embedded pulsating heat pipe device as a stand alone component. The pinching operation maintains a vacuum seal for the micro-channel pulsating heat pipe device.

Once the top layer 10 and bottom layer 12 are welded together this device becomes a unitary substrate having an embedded micro-channel. The opposite edges of the micro-channel form the evaporator region and the condenser region respectively. This structure then can be conveniently mounted at a heat source area. The heat will begin the evaporation process generating slugs of gas and liquid flow.

In the embodiment shown in FIG. 2, the serpentine micro-channel trace has opposed first and second end regions. A first end region includes the first edge bends 20. The opposed, second end region includes the second edge bends 22. The first edge bends 20 can act as the evaporator area, with the second edge bends 22 acting as the condenser area, or the first edge bends 20 can act as the condenser area, with the second edge bends 22 acting as the evaporator area. As these bends 20, 22 act as the evaporator and condenser areas, in at least this embodiment the serpentine micro-channel trace has a first end region having an evaporator region and has an opposed second end region having a condenser region.

Figure 10A:
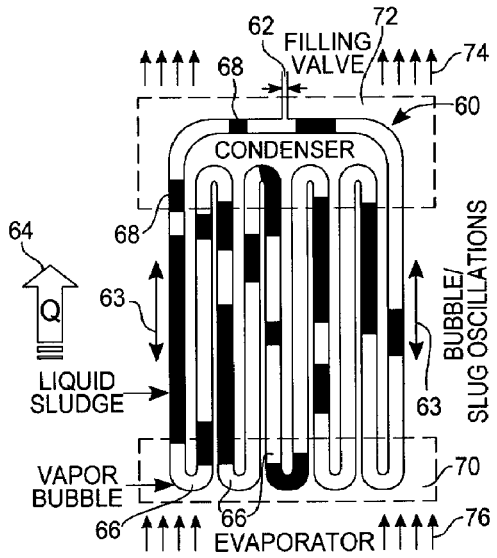
FIG. 10*a* is a conceptual view of fluid flow in an embodiment of the invention.
Figure 10B:
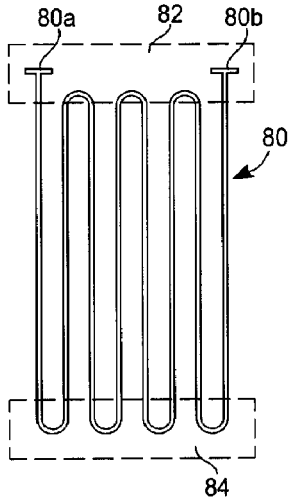
FIG. 10*b* is a conceptual view of an open loop embodiment without a flow check valve.

The slug flow may be understood in relation to the conceptual views shown in FIG. 10*a*. In this view micro-channel 60 includes fill valve 62 allowing introduction of a liquid into the micro-channel to partially fill the micro-channel with the unfilled zone being a vacuum. The valve may then be closed such that liquid does not escape and gas does not escape or enter micro-channel 60. An evaporator region 70 is the location of a plurality of bends in micro-channel 60. A heat source represented by arrows 76 cause portions of liquid slugs 68 to evaporate creating or expanding vapor bubbles 66. These vapor bubbles drive heat in the direction of arrow 64 causing bubbles/slug oscillation within the micro-channel as illustrated by arrows 63. The evaporator region will generally cause oscillation in the direction of condenser region 72. At the condenser region heat is transferred in the direction of arrow 74. This causes a condensation of vapor bubbles 66 into new liquid slugs 68 or expands existing liquid slugs 68. This configuration provides an efficient method of heat transfer.

Concept views 10*b*, 10*c* show different possible micro-channel configurations. With respect to 10*b* micro-channel 80 is shown having closed ends 80*a*, 80*b*. Ends 80*a*, 80*b* may be the locations of a pinch clamp-type fill tube. Such locations allow a liquid to be introduced into the micro-channel through the use of a fill tube. Once the fill tube is removed, the ends are automatically closed, sealing micro-channel 80. The slug flow will oscillate as heat is introduced through evaporation region 84 and heat is removed through condenser region 82.

Figure 10C:
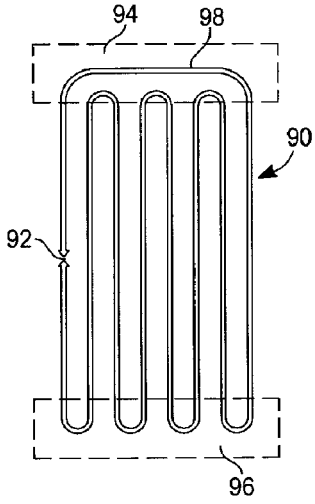
FIG. 10*c* is a conceptual view of a closed loop with a flow check valve.

With respect to FIG. 10*c* an alternative conceptual view is shown. In this view micro-channel 90 includes a fill valve 92. Fill valve 92 allows a liquid to be introduced into the micro-channel 90. This fill valve shown as 92 is also possible to be a check valve that allows flow in only one direction.

Figure 11:
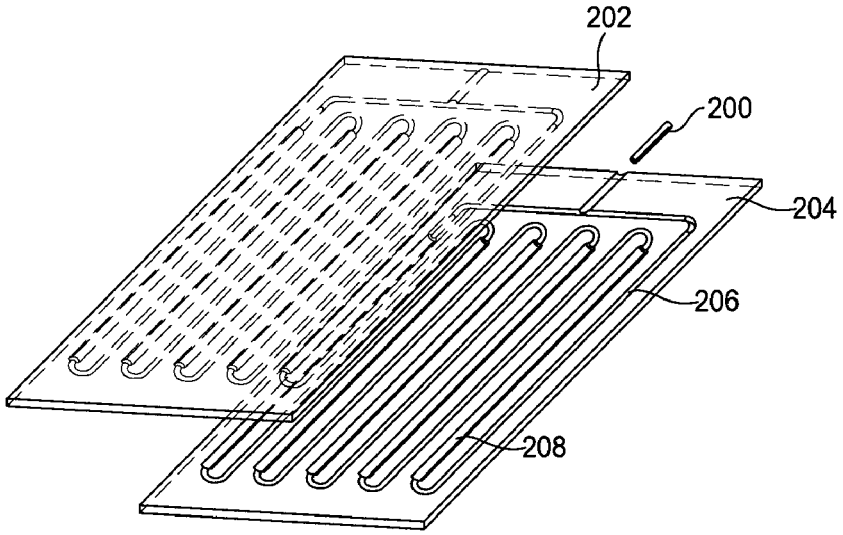
FIG. 11 is a partially exploded view of an embodiment in which the micro-channel has sections of a narrower and less narrow diameter.

The micro-channel also has an evaporator region 96 and a condensation region 94. In this configuration a radiator bar 98 is proximate to an edge of a substrate in which the micro-channel is embedded. The radiator bar is defined as the area of the micro-channel closest to the edge at which heat is radiated and spans a plurality of bends in the micro-channel as is shown in FIG. 10*c*. Such configuration may allow for efficient heat transfer. Looking at FIG. 10*c* as a conceptual pulsating heat pipe, it can also be turned into an annular flow device that is achieved by alternating the individual diameters of the micro-channels. In this approach there is actually two micro-channel diameters present in the device. One such embodiment is shown in FIG. 11, which includes a full tube 200, a first substrate 202, and a second substrate 204. Substrates 202 and 204 can be joined together to form a unitary structure. Full tube 200 is insertable into a channel that leads to a serpentine micro-channel formed by traces on the substrates 202, 204. These traces include a micro-channel trace of a narrower cross-sectional dimension 206, and a trace 208 having a broader cross sectional dimension. This could be a rounded trace having a larger cross section, a rectangular trace having a width or depth having a larger cross section, for example. The micro-channels remain of capillary dimensions. When one micro-channel is slightly larger than the other and they alternate throughout the structure, a pre-determined flow path can be established allowing annular flow to be achieved. Annular flow allows heat to be transferred via vaporization (verses the sensible heat flow achieved in slugs/bubbles flow.)

The conceptual pulsating heat pipe embodiment illustrated in FIG. 10*a* is partially charged with cooling fluid that is allowed to exist in a vapor-liquid phase. This figure shows how a pulsating heat pipe operates and its two basic configurations: open and closed loop. Heat is applied to the evaporator area of the tubing resulting in increased vapor pressure and disrupting the equilibrium of the system. As the vapor pressure increases, larger vapor bubbles are created and pulse from this high-pressure area. At the other end of the assembly is the condenser. In this area heat is removed and in so doing the vapor is reduced shrinking the bubbles and reducing the pressure. Initial tests have shown that pulsating heat pipes can provide three to 12 times the thermal conductivity of aluminum. The primary limitation has been that commercially available tubing diameters need to be smaller in order to improve performance and achieve the desired advantages to pulsating heat pipes. By embedding micro-channels into thin flat plates so that components and assemblies can be easily mounted to their surfaces, the devices are made adaptable to numerous devices that improve performance with thermal transfer.

When high heat fluxes are introduced using a modified heat pipe as described previously with alternating tube diameters annular flow can be achieved and in so doing significant jumps in thermal transfer can be achieved in addition to the previously mentioned 3 to 12 times.

Figure 3:
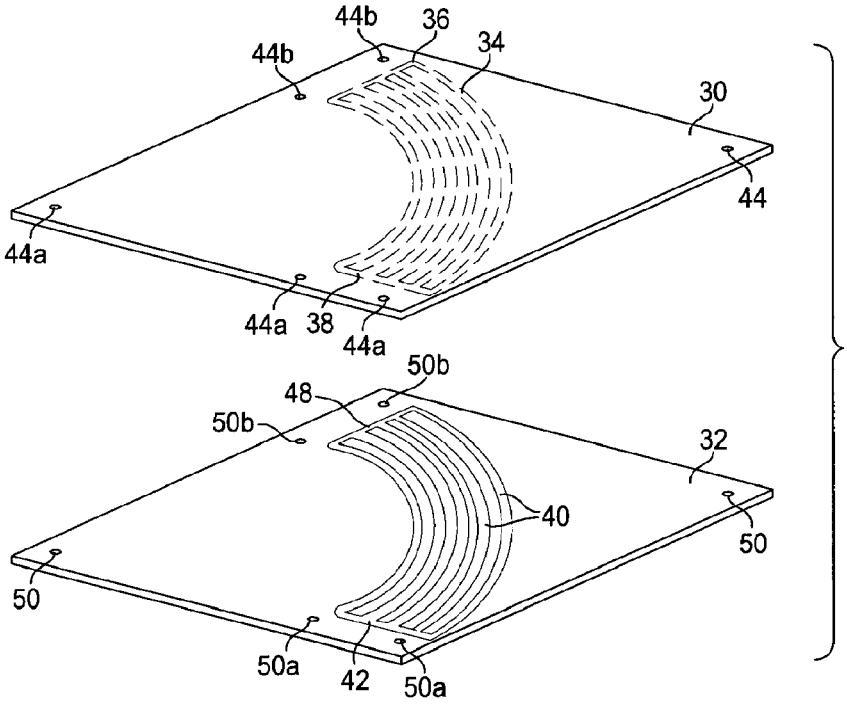
FIG. 3 is a top perspective exploded view of an alternative embodiment of the present heat pipe.

In FIGS. 2, 10*a*, 10*b*, and 10*c*, the evaporator region and condenser region are shown as being opposite to each other across a substrate in which the micro-channel is embedded. This may be a highly useful configuration in a number of applications. In FIG. 3 an alternative embodiment is illustrated. In this embodiment, the evaporator region is confined to a corner of the substrate and the radiator region is located at a second corner of the substrate. The evaporator region and condenser region are oriented with a 90 degree bend. As shown in FIG. 3, top layer 30 may be joined to bottom layer 32 through use of mounting holes 44, 50, 44*a*, 44*b*, 50*a*, 50*b*. Top layer 30 includes a serpentine micro-channel trace 34 on the bottom side of top layer 30. This matches with a serpentine micro-channel trace 40 on bottom layer 32 such that when the top layer and bottom layer 32 are fixed together a single micro-channel is formed. In this micro-channel a heat sink edge manifold 36, 48 feeds a number of lengths of the micro-channel which radiates from this manifold. In a similar manner heat source edge manifold 42, 38 form a portion of the evaporator region and feed a number of lengths of the micro-channel which extend from this manifold. The mounting holes of 50*a*, 44*a*, specifically allow attachment of the device to a location proximate to a heat source. Similarly mounting holes 50*b*, 44*b* allow mounting at the heat sink.

Figure 4A:
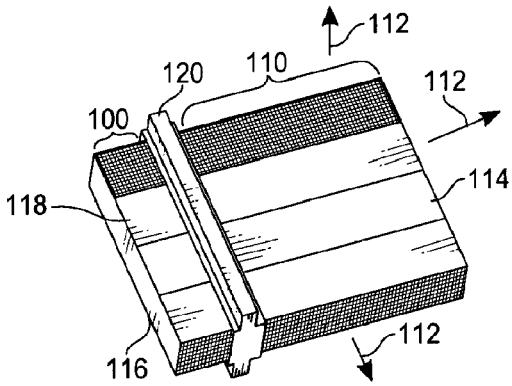
FIG. 4*a* is a top front perspective view of an embodiment of a stacked sheet heat pipe.

With reference to FIG. 4*a*, a stacked layer embodiment of a heat pipe is shown. This device includes an evaporation area/heat source region 100 and a condensation area/heat sink region 110 separated by wall 120. Wall 120 for example, may be a wall separating the interior of a space craft with the exterior of a space craft. Arrows 112 show the directions in which heat may radiate from this device, illustrating that heat may be radiating from all sides of the device. Cover 114 is made from a material which allows heat radiation as subsequently will be discussed. Mounting surfaces 116, 118 may be used to mount this device onto a heat generating source.

Figure 4B:
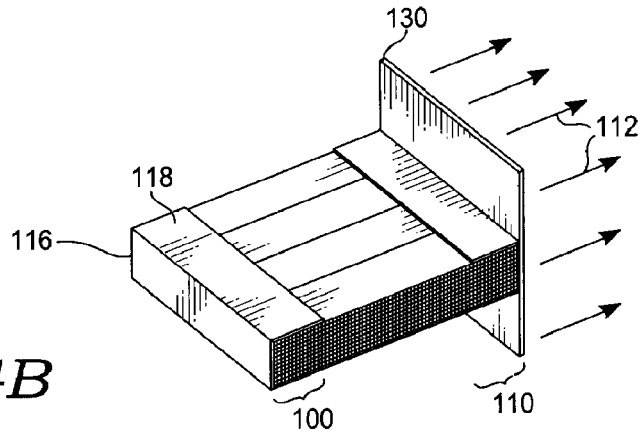
FIG. 4*b* is a top back perspective view of an embodiment of a stacked sheet heat pipe.

With reference to FIG. 4*b*, evaporation area 100 and condensation area 110 are shown. Mounting surfaces 116, 118 allow attachment to a heat generating source. Perpendicular radiation plate 130 allows transfer of heat 112, as by radiation or convection. In a more advanced device the radiator plate shown as item 130 can also have micro-channels embedded into it. This will allow the plate shown as 130 to be larger, bigger, and transfer significantly more thermal energy at a higher capacity.

Figure 5A:
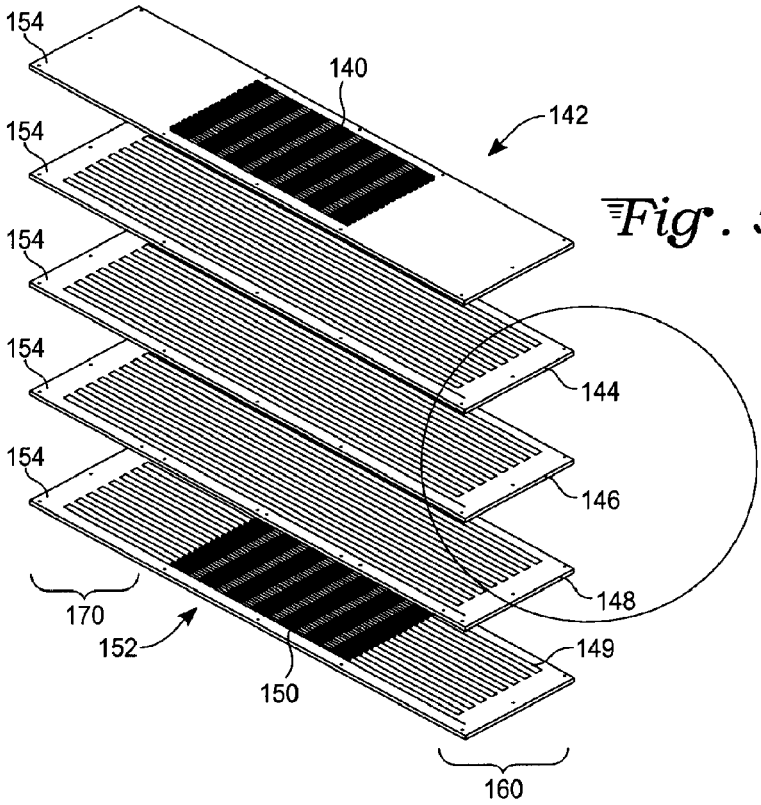
FIG. 5*a* is a top perspective exploded view of an embodiment of a stacked sheet heat pipe.

The embodiments shown in FIGS. 4*a*, 4*b* may employ a number of stacked substrate layers. With reference to FIG. 5*a*, an exploded view is shown showing a top substrate layer 142, first micro-channel layer 144, second micro-channel 146, third micro-channel layer 148, and bottom substrate layer 152. Each of these layers may have a micro-channel trace 149. In addition, each layer may have mounting holes 154. These mounting holes may be used during the bonding of the layers together to form a unitary structure. Pins may be inserted into these holes during bonding and removed following bonding. The mounting holes may also be used to attach the final structure to either a surface skin which encases the structure or onto a heat sink and heat source. As illustrated the device would have a condensation area/heat sink 160 and a evaporation area/heat source 170. On top substrate layer 142 an adiabatic section 140 may be used. The bottom substrate layer 152 also includes an adiabatic section 150. In this way the stacked layer of pulsating embedded micro-channel substrates would allow heat absorption at one end, heat radiation and a second end, and would have a central section in which heat is neither absorbed nor radiated.

Figure 5C:
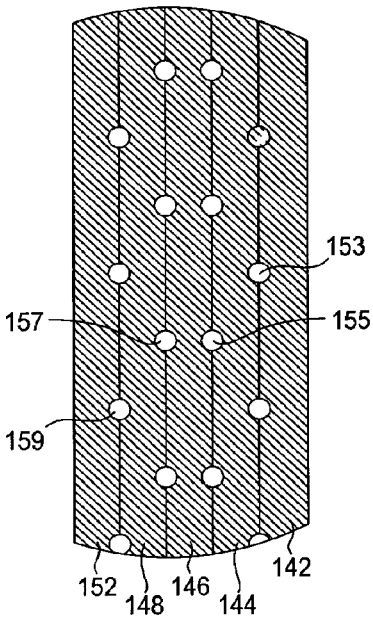
FIG. 5*c* is a partial cross-sectional view of FIG. 5*a*.
Figure 5B:
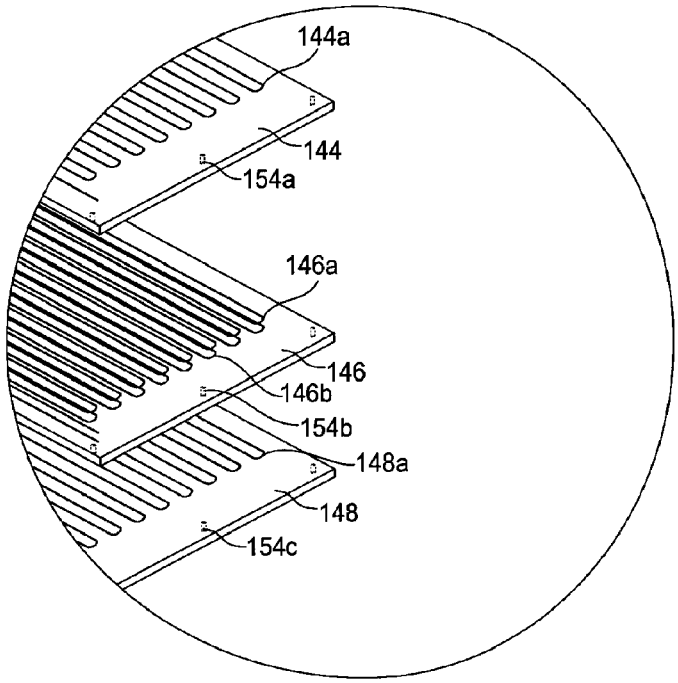
FIG. 5*b* is a detail of FIG. 5*a*.

A detail of FIG. 5*a* is shown in FIG. 5*b*. Mounting holes 154*a*, 154*b*, 154*c* align. As noted this may be useful for both mounting of the device and manufacture of the device. First micro-channel layer 144 includes on its bottom side a first layer bottom surface micro-channel trace 144*a*. This meets with second layer top surface micro-channel trace 146*a* to form a first micro-channel when substrate 144 and 146 are joined. A second micro-channel is formed by a second layer bottom surface micro-channel trace 146*b*, forms a second micro-channel by mating with third layer top surface micro-channel trace 148*a*. In this way a plurality of stacked layers may form a plurality of serpentine micro-channels throughout the depth of a device as shown in FIGS. 4*a*, 4*b*.

With respect to FIG. 5C a cross section of the final assembled device after the various substrate layers are affixed together. The substrates 142, 144, 146, 148, and 152 are all attached together, as by diffusion bonding, liquid interface diffusion bonding or metallurgical joining to create a unitary structure. This unitary structure improves performance and increases redundancy. Substrates 142 and 144 have surface traces that combine to form serpentine channel 153. In a similar fashion, the bottom side of substrate 144 and topside of substrate 146 also have serpentine traces that together form serpentine channel 157. In a similar manner, serpentine micro-channels 157 and 159 are formed by joining traces on substrates 146/148, and 148/152 respectively. Each of the serpentine micro-channels is staggered from the micro-channel above when viewed in cross section. This provides for more efficient heat conduction through the thickness of this device.

Figure 6A:
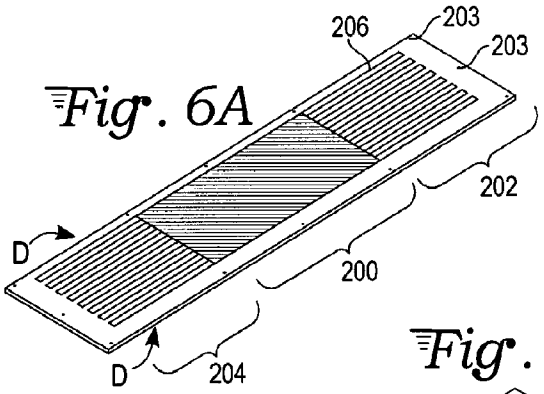
FIG. 6*a* is a top perspective view of a single panel from an embodiment of a stacked sheet heat pipe.

With respect to FIG. 6A, a bottom substrate of FIG. 5A is illustrated. As explained with respect to FIG. 5A, this is part of a stacked group of substrates which may be diffusion bonded together or other joined to form a single unit. With reference to FIG. 6*a*, the central area 200 is an adiabatic region that has been light weighted since no heat will be introduced or removed from this area.

On the opposite ends are condenser section 202 and evaporator section 204. Mounting holes 208 allow attachment of the device for mounting, and may be used for alignment during manufacturing. A transparent view of a serpentine trace 206 is shown on the device.

Figure 6B:
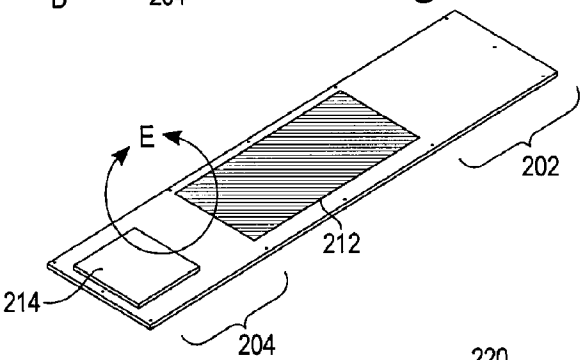
FIG. 6*b* is a top perspective view of a single panel from an embodiment of a stacked sheet heat pipe showing a heat-absorbing element.
Figure 6C:
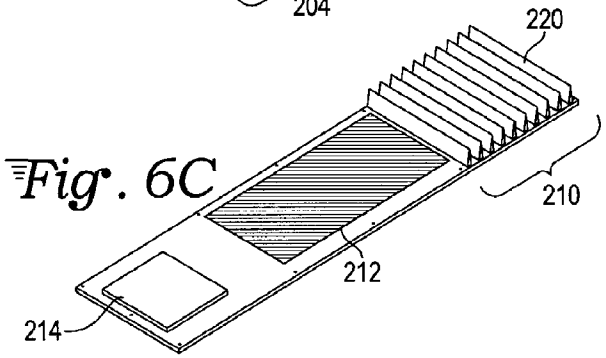
FIG. 6*c* is a top perspective view of a single panel from an embodiment of a stacked sheet embedded micro-channel pulsating heat pipe showing heat radiating fins.
Figure 6E:
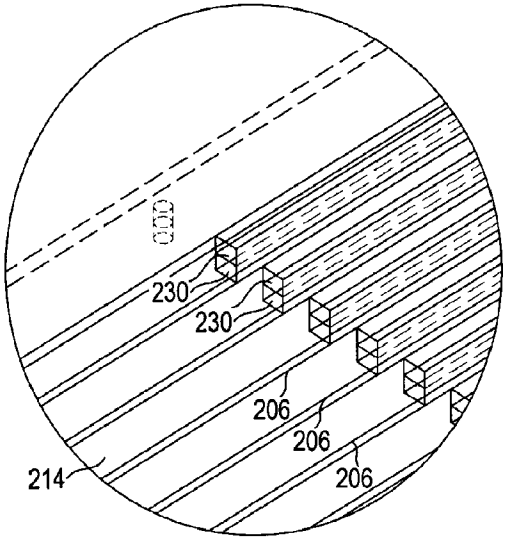
FIG. 6*e* is an enlarged view of the section of FIG. 6*b* along lines E.

FIGS. 6*b*-6*c* illustrate embodiments showing the opposite side of this device. A heat load source 214 may be mounted on or against the evaporator section 204. The micro-channel (not shown) provides a means for the heat to efficiently travel to the condenser section 202. In FIG. 6*c*, heat radiation fins 220 have been attached to the condenser section to allow for a greater surface area for the radiation of heat or convection if air is passed over them. A more significant set of fins can be added at 220 by applying micro-channels within the fins.

Figure 6D:
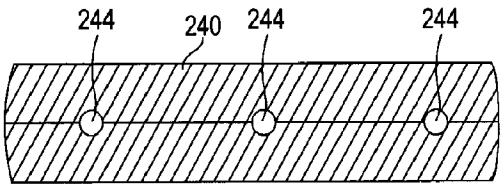
FIG. 6*d* is a partial cross section along lines D in FIG. 6*a*.

A partial cross section of the section indicated by lines D in FIG. 6A is shown in FIG. 6D. This cross section shows substrate 240 joined to substrate 242 to form a serpentine micro-channel 244. FIG. 4E is an enlarged view of the section defined by line E in FIG. 4B. A serpentine trace 206 is shown on the bottom of the substrate, and heat load source 214 is mounted over a section of this serpentine trace. For weight reduction, areas 230 have been etched out of the substrate. This can significantly reduce weight of the heat pipe for applications where lower weight is of high importance.

Figure 7:
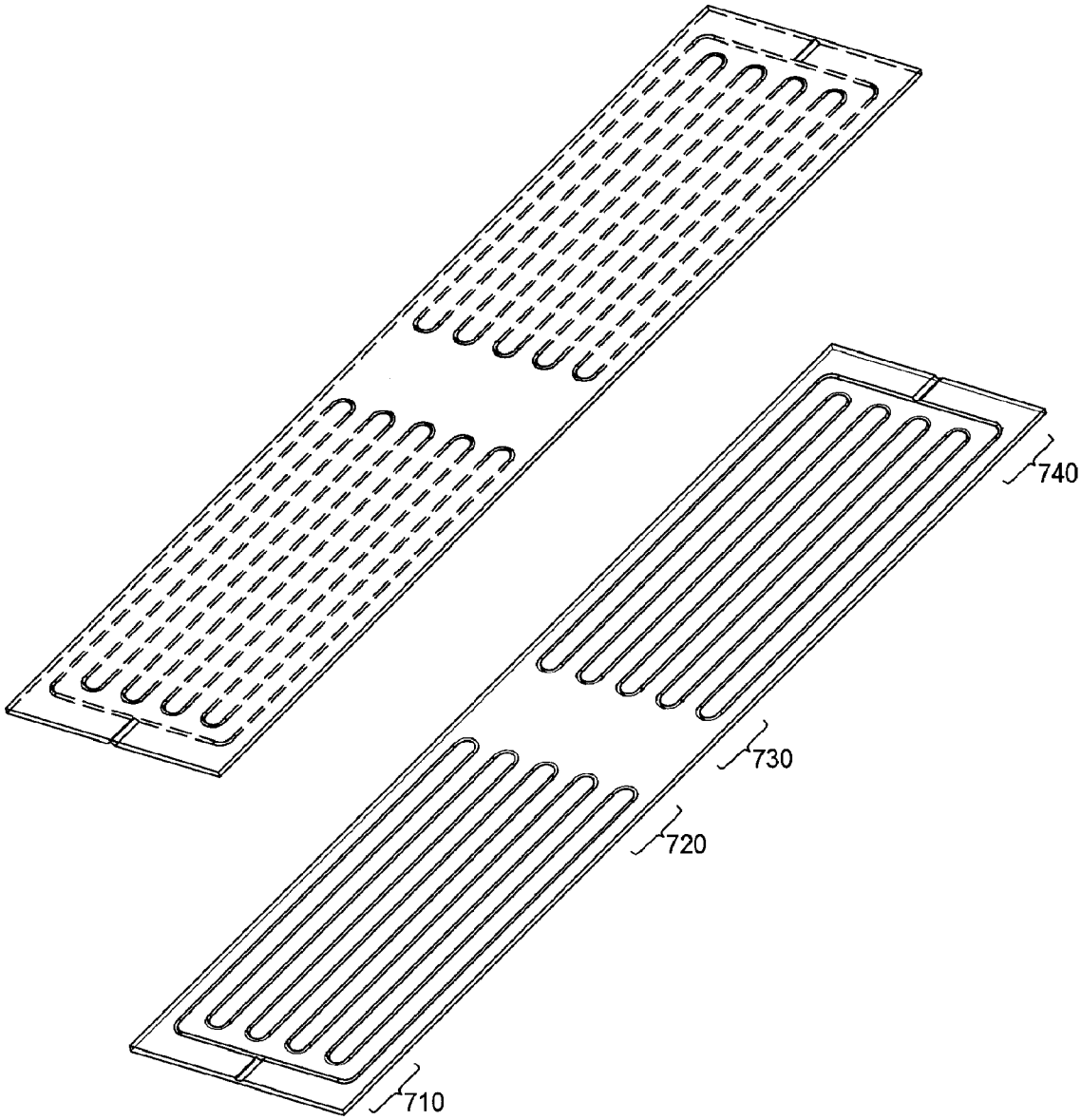
FIG. 7 is an exploded perspective view of a series configuration of micro-channel embedded pulsating heat pipes.

FIG. 7 shows a micro-channel embedded pulsating heat pipe in a series configuration. In this particular application heat is introduced at area 710 and it is transferred from one set of micro-channel embedded pulsating heat pipes to the other at location 720 and 730. Heat is extracted at the condensation location indicated by section 740.

Figure 8:
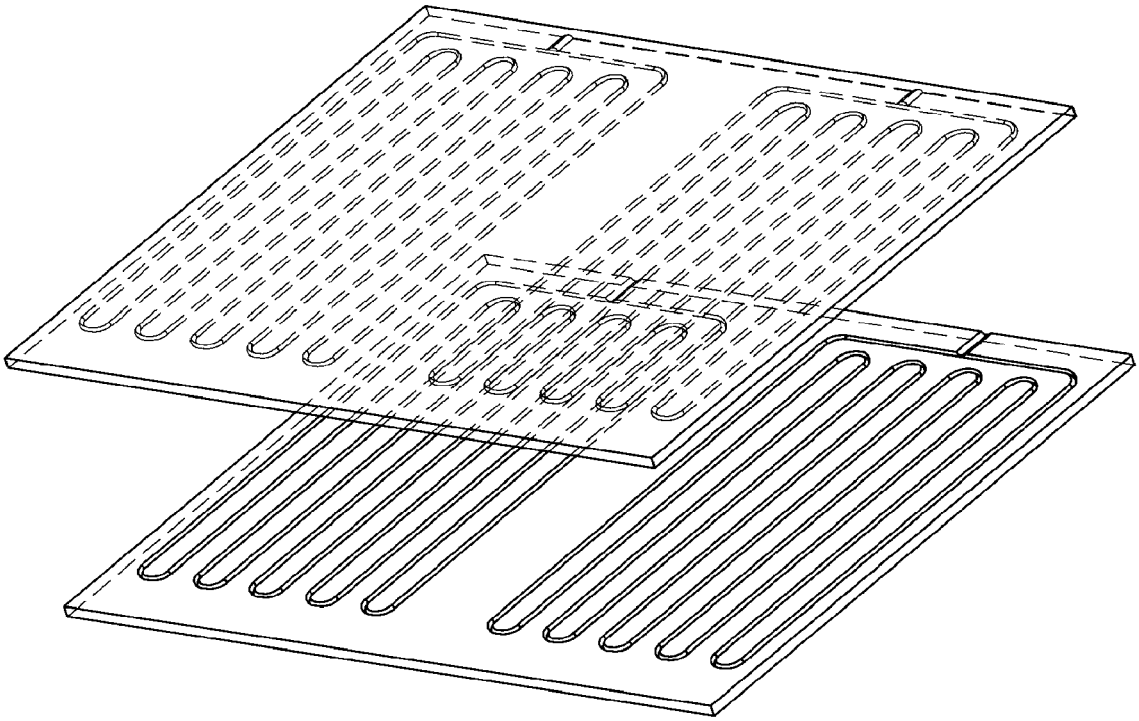
FIG. 8 is an exploded perspective view of a parallel configuration of micro-channel embedded pulsating heat pipes.

FIG. 8 shows a micro-channel embedded pulsating heat pipe in a parallel configuration in this particular application the functionality of the micro-channel embedded pulsating heat pipe has doubled due to the stacking and parallel operation of these two micro-channel embedded pulsating heat pipes.

Figure 9:
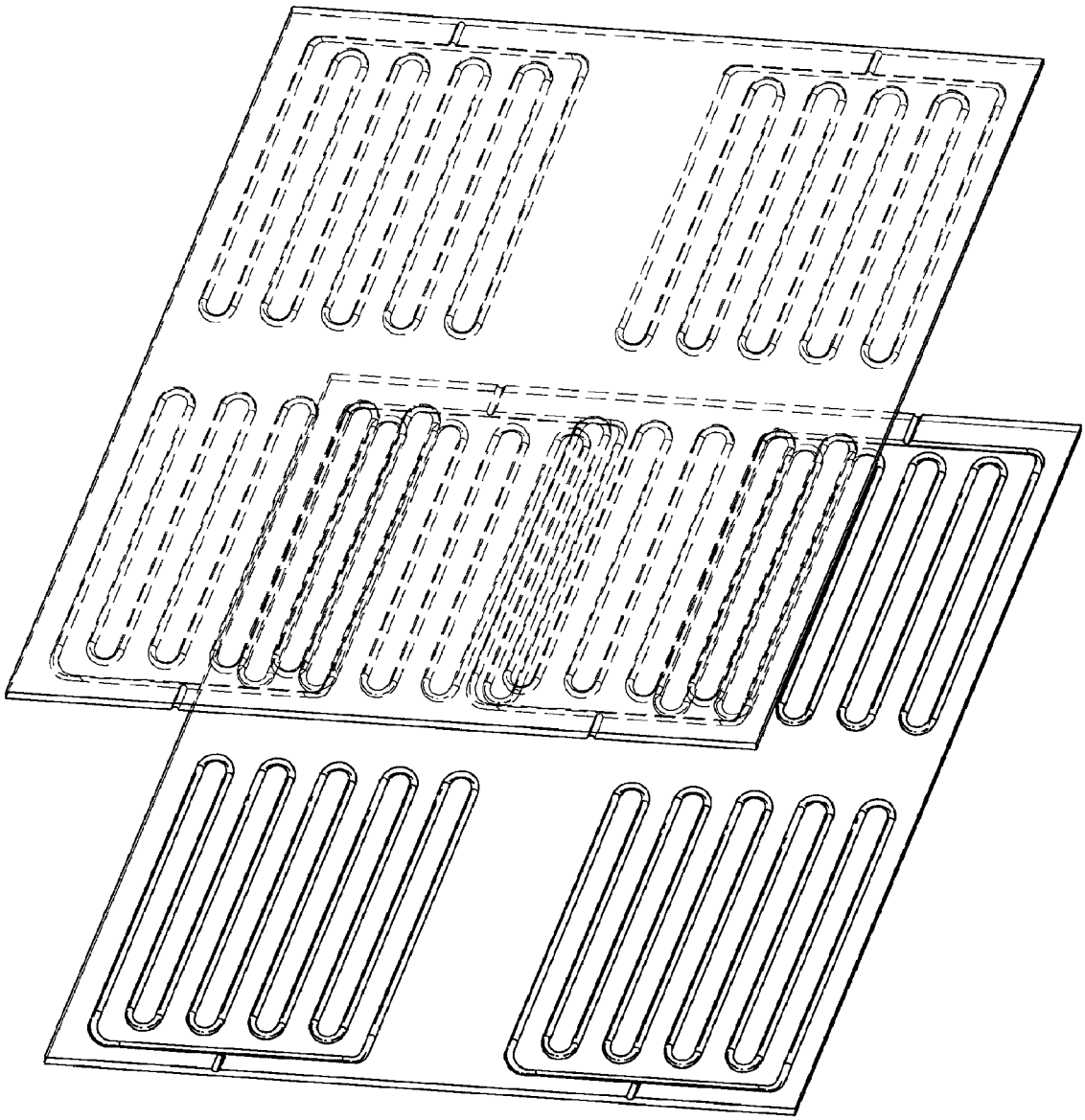
FIG. 9 is an exploded perspective view of micro-channel embedded pulsating heat pipes with multiple heat sources and multiple heat sinks.

FIG. 9 shows a micro-channel embedded pulsating heat pipe with multiple heat sources and multiple heat sinks. In numerous applications discrete electronic components can be located in general locations and contribute to the overall heat load of the device. Heat sinks can also be located on numerous locations on the micro-channel embedded pulsating heat pipe in order to increase the load carrying capability of the micro-channel embedded pulsating heat pipe.

In some embodiments, the radiating surface is covered with a high emittance and low solar absorptance coating or with optical surface reflectors (OSRs) for the purpose of maximizing radiant energy into deep space. Micro-channel embedded heat pipes can assist in thermal energy from a warm source into the heat pipe and from the heat pipe into the radiator. Currently both of the evaporator and condenser are limited because they simply follow Fourier's conduction law to transfer heat from the warm source to the cold wall via conduction.

The approach described herein of embedding the pulsating heat pipes by photoetching micro-channels into sheets and plates then diffusion bonding those sheets and plates into monolithic structures with integral cooling passages addresses a number of present needs for thermal transfer. It will allow production of micro-channels down to 0.127 mm, nest them tightly together, and precisely orient them in any and all directions desired using a proven mass production process. Further adaptations and material changes could potentially allow smaller channels.

The use of embedded micro-channel is predicted by models to allow an order of magnitude or more jump in the thermal conductivity of conventional materials like aluminum and copper via integral embedded heat pipes. Micro-channel embedded pulsating heat pipes (herein after abbreviated as ME-PHPs) will turn conventional heat sinks, conduction cores, sidewalls, cold walls, face sheets, base plates, and radiators into high thermal conductivity solutions. There is also no reason why they couldn't be stacked one upon another like a deck of cards creating a large cross section conduction bar or cold plate with the intent of holding a detector or instrument to within a +/−1° K differential or better.

It will be readily apparent that the present embodiments allow a number of advantages including:

The evaporator and condenser can be placed anywhere within the plane of a sheet or substrate.

In the plane of a sheet or substrate, the ME-PHPs are protected from dents, dings and general damage from handling and inadvertent impacts. Components could be mounted on both sides of the ME-PHP. If physical tubes are used, they are exposed on one side or the other of a component and will always be at risk of damage. In addition they take away one side of the heat exchanger from being populated.

Multiple evaporators and condensers can be placed in the same sheet or substrate allowing for multiple heat load sources and multiple heat sinks. These could be placed both in series and in parallel.

Since they are in sheet form, they physically could be stacked one on top of another.

Through stacking (and specifically offset stacking) redundancy can easily be designed into ME-PHPs.

The ME-PHPs could be made to handle one specific thermal problem or designed to cover a large area surface with the intent of transferring heat anywhere throughout that surface. For example, this could effectively be a facesheet on a honeycomb panel enhancing or replacing the heat pipes.

A ME-PHP could also be bent into various shapes after formation. Bending would allow their use in different areas such as on spacecraft buses where it has been traditionally difficult to conduct thermal energy into deep space. (i.e., the condenser portion of a ME-PHP could be brought out of a spacecraft and bent so that it points into deep space for radiating purposes.)

Through embedding the pulsating heat pipes, a designer may place the evaporator portion of the heat pipe under a warm load anywhere in the plate and then transfer that heat to a condenser anywhere else on the plate either directly or through a ladder approach.

Capillary pumped loop heat pipes typically have defined flows of liquid, slug and vapor regimes and they typically use a wick within the evaporator section. Pulsating heat pipes depend upon the coexistence of vapor bubbles and vapor slugs throughout a fluid. They do not require wicks or external mechanical systems for them to provide their cooling activity.

The following background provides a simple review of an exemplary thermal control such as on a 3 axis stabilized geo-synchronous communication satellite. In addition, background on ME-PHPs or pulsating heat pipes is also provided.

Conduction follows Fourier's law and is described by the equation.

$$Q=KA\Delta t/L \qquad \text{(Equation 1: Fourier's Conduction Law)}$$

Where; Q=Power or heat dissipation in Watts
K=Thermal Conductivity in W/m ° K
A=Area in $m^2$
Δt=Temperature differential in ° K
L=Length in m
We re-write the equation for determining Δt as:

$$\Delta t=QL/KA \qquad \text{(Equation 1.1)}$$

We can demonstrate the advantages of ME-CPLs by looking at a simple conduction plane/heat sink example for a 30-Watt warm source mounted in the middle of an 6061T6 aluminum plate 6.5"×6.5"×0.100" thick, mounted edgewise over a heat pipe. We determine the temperature difference between the center of the plate where the warm source is mounted and the edge of the plate just before reaching the interface with the heat pipe as follows. Then, Q=30 Watts
K=170 W/m ° K (Thermal conductivity for 6061T6 Al)
A=0.100"×6.5"=0.65 $in^2$=0.00042 $m^2$
L=3.25"=0.08249 m
Therefore;
Δt A16061T6=QL/KA=(30 W)(0.08249 m)/(170 W/m° K)(0.00042 $m^2$)
Δt A16061T6=34.66° K difference from the 30 Watt warm source to the edge of the Heatsink.

In certain space borne applications, if this 34.66° K differential is too large, the limited options for thermal transfer may require a designer to increase the thickness of the conduction path from 0.100" to something larger thereby increasing the area, A, which adds weight to the system or move the 30 Watt warm source closer to the heat pipe to reduce the distance, L.

The advantage of ME-PHPs is that experimental data suggests that a 3 to 12 times increase of thermal conductivity over aluminum can be achieved. This may be realized through the use of ME-PHPs in this application resulting in the following thermal benefit.

Between; Δt MEPHP×3=11.55° K
and; Δt MEHP×12=3.15° K

ME-PHPs brings two advantages to the forefront. The first is that ME-PHPs as a direct replacement can bring the operating temperature of a warm source to a significantly lower temperature. The second is that if the operating temperature of the warm source is acceptable as is, then it could be placed much further away thus allowing the engineer better utilization or optimization of an interior volume. In both cases one gains substantial advantage over the thermal control of the warm source.

Currently, pulsating heat pipes under laboratory testing have demonstrated their ability to provide the thermal conductivity that will achieve up to a magnitude increase over conventional materials like aluminum. A micro-fabrication approach to manufacture ME-PHPs could use printed circuit board technology to chemically mill micro-channels into plates and then stack those plates one on top of another through diffusion bonding creating a monolithic plate with embedded micro-channel Pulsating Heat Pipes. This technology is described in detail as follows.

A micro-channel embedded pulsating heat pipe (ME-PHP) simply consists of a micro-channel in a serpentine configuration placed in the middle of a plate (such as is shown in FIG. 2 and others). To charge the ME-PHP, the micro-channel is evacuated to a hard vacuum and then filled partially with a working fluid, which distributes itself naturally in the form of liquid vapor slugs/bubbles inside the micro-channel as described in relation to FIG. 10*a*. There are distinct regions to the pulsating heat pipe, including the evaporator, condenser, and potentially an adiabatic regions. When the pulsating heat pipe is at rest with no heat being introduced and no heat being removed the system is in equilibrium. The system becomes unbalanced when heat is applied to the evaporator. In turn the heat converts more of the working fluid to vapor and the vapor bubbles become larger within that portion of the pulsating heat pipe. Likewise, at the condenser, heat is being removed from the ME-PHP and the bubbles are reducing in size. The volume expansion due to vaporization and the contraction due to condensation cause an oscillating motion within the channels. The net effect of the temperature gradient between the evaporator and the condenser and the perturbations introduced from the serpentine pattern of the micro-channels is the creation of a non-equilibrium pressure condition. Combine this with the vapor/fluid fill distributed throughout the ME-PHP and you have the self-sustaining driving force for oscillations to provide thermo-fluidic transport. Since these pressure pulsations are fully thermally driven and due to the solid-state construction of the ME-PHP, there is no need for external power or energy beyond the thermal input from a warm source to operate the ME-PHPs. In some embodiments some active components may be employed, such as a circulation pump at the valve or a chiller at the condenser to aid in heat removal.

The slug/bubble oscillations within the pulsating heat pipes are still not fully understood but the theoretical tolerable inner diameter limit of the ME-PHP micro-channels is defined by:

$$Eo=(Bo)^2=4$$

Where:

ES=EtitvOs number=$L^2$ (PrPO/a Bo=Bond number=D·(g(pi−pv)/415; L=length (m);

D=diameter (m)

At diameters below Eo=$(Bo)^2$=4 surface tension is sufficiently present to assist in the creation of stable liquid slugs/bubbles. As the ME-PHP micro-channels exceed this number and become larger, the surface tension becomes less of a factor leading to stratification of distinct phases. At this point the ME-PHP behaves like a two-phase thermosyphon.

Presently the fluids that have shown potential for use with ME-PHPs are ethanol, water and acetone.

A number of the current embodiments embed the pulsating heat pipes within the plane of flat sheets/plates by using printed circuit board technology to micro-machine the channels along with diffusion bonding technology to assemble the ME-PHPs. Each of these processes has proven feasibility.

Printed Circuit Board Fabrication (Photoetching) is a process where a metal is etched with very fine detail. This process is readily available and well characterized. It starts with a piece of sheet metal or foil to which a photoresist is applied. A mask, which appears as a photographic negative, is indexed to the prepared metal and they are placed into a high intensity light bench. Essentially, this process develops the mask selectively onto the photoresist creating a chemical resistant mask that rigidly attaches to the metal protecting it in some areas and leaving it exposed in others. Chemical etching of the unprotected metal follows. This process allows etching through parts or partially through a metal surface allowing formation of through holes and channels where desired and in any shape that can be drawn. The key advantages of printed circuit board fabrication is that it is readily available, has a long history and the process is fully characterized. The process can easily produce large panels in the 18"×36" size and is easily scaled. Very detailed channels as small as 0.005" can be obtained up to over 0.250". Any basic shape can be etched into the sheets, serpentine channels, wavy patterns, tapered channels, straight channels, and other very detailed shapes. Different patterns or slight modifications on the same sheet can also be applied to influence the thermal conductance path. Multiple ME-PHPs can also be etched into the same panel in a side-by-side, end to end or even in oblige patterns.

Diffusion Bonding:

In its simplest concept, diffusion bonding is the bringing together of metal detail parts under temperature and pressure to allow for grain growth across the interface boundary. In combination with photoetching, it can create a stack up of multiple layers with integral micro-channels. The ME-PHPs can be placed one on top of another with almost endless possibilities. The as diffusion bonded stack up will appear in cross section as a monolithic block with integral flow passages. Any thermal impedance due to the metal joining uncertainty is eliminated. Many types of materials can be diffusion bonded including: Copper, Inconel, Stainless Steel, Titanium, Nickel, Silver, and others. Another key advantage to this process is that it is step-able. Subassemblies can be diffusion bonded and qualified and then those subassemblies can be diffusion bonded together making even a more robust process/assembly such as those shown in FIGS. 3*a*, 3*b*, 5*a*, 5*b*, etc., examples of a diffusion bond cross section of a flat plate to photoetched channel.

Illustrated ME-PHPs are based upon two photoetched channels aligned and diffusion bonded together to create a monolithic round channel.

After the top and bottom sheets of the pulsating heat pipes are bonded together they form a monolithic serpentine pattern embedded within the sheet. A pinched tube has also been integrated into the assembly and connects to the internal micro-channels. Using a vacuum pump attached to the pinch tube the internal micro-channel cavity is evacuated to a hard vacuum down to a leak rate lower than 10-4 standard cc's per second of helium or better. With his vacuum maintained, a valve is opened tee'd off from the pinch tube and the working fluid is allowed to be drawn into the micro-channels. The amount of fluid drawn in is accurately measured in order to achieve a certain percent fill of the micro-channel cavities. Typically the fill ratio is somewhere between 20 to 80 percent. Once the appropriate amount of working fluid has been introduced the pinched tube is pinched off creating a vacuum type seal and separating the filling device from the micro-channel pulsating heat pipe device. This makes our micro-channel embedded pulsating heat pipe device a separate entity totally self-contained. The pinching off mechanism creates a vacuum tight seal.

Benefits from ME-PHPs

ME-PHPs offer the promise of increasing thermal conductivities of standard materials by three to 12 times or possibly more. ME-PHPs are advantageous for a number uses in electronics and instrumentation including spacecraft thermal control because they can be placed in the existing conduction path of the thermal energy. They can be embedded in heat sinks, conduction cores, sidewalls, enclosures, housings, face sheets, heat spreaders and radiators. In addition some of the key advantages are:

1) Multiple ME-PHPs can be integrated into the same plate or sheet.

2) ME-PHPs can be placed or populated more intensely on some areas of a plate then others, allowing the designer to focus their thermal control needs.

3) They can be placed in a series or parallel arrangements or even oblique arrangements.

4) ME-PHPs can be produced from normal metal materials thereby matching coefficients of thermal expansion to existing hardware.

5) Through diffusion bonding they can be stacked one on top of another as a joined structure, or stacked as unbonded structures.

6) When stacked one on top of another they can be designed such that the micro-channels are staggered to provide redundancy and robustness from potential impacts (e.g., micrometeor or space debris impacts for spacecraft applications).

7) Theoretically, there are no size constraints. An entire face sheet of a honeycomb panel could have embedded micro-channels for pulsating heat pipes.

8) The micro-channels presently can be produced anywhere from 0.127 mm up through 6.0 mm and different sizes are possible, meaning that both could exist side-by-side or in different layers.

TABLE 1

A Comparison of Polymer Matrix Composite, Metal Matrix Composites and Carbon/Carbon Composite materials to Micro-channel Embedded Pulsating Heat Pipes

| Reinforcement | Matrix (or Metal) | Thermal Conductivity W/mK | CTE PPM/K | Modulus GPa | Specific Gravity | Specific Thermal Conductivity |
|---|---|---|---|---|---|---|
| — | Aluminum | 218 | 23 | 69 | 2.7 | 81 |
| — | Copper | 400 | 17 | 117 | 8.9 | 45 |
| — | Epoxy | 1.7 | 54 | 3 | 1.2 | 1.4 |
| Copper | Tungsten | 167 | 6.5 | 248 | 16.6 | 10 |
| Copper | Molybdenum | 184 | 7.0 | 282 | 10.0 | 18 |
| Continuous Carbon Fibers | Epoxy | 330 | −1.1 | 186 | 1.8 | 183 |
| Discontinuous Carbon Fibers | Polymer | 20-330 | 4-7 | 30-140 | 1.6-1.8 | 12-183 |
| Continuous Carbon Fibers | Carbon | 400 | −1.0 | 255 | 1.9 | 210 |
| Silicon | Aluminum | 126-160 | 6.5-13.5 | 100-130 | 2.5-2.6 | 49-63 |
| SiC Particles | Aluminum | 170-220 | 6.2-16.2 | 106-265 | 3.0 | 57-73 |
| Discontinuous | Aluminum | 400-600 | 4.5-5.0 | 90-100 | 2.3 | 174-260 |
| Carbon-Diamond Particles | Aluminum | 550-600 | 7.0-7.5 | — | 3.1 | 177-194 |
| ME-PHPs | Aluminum | 600 to 2400 | 23 | 69 | 2.45 | 245 to 980 |
| ME-PHPs | Beryllium | 600 to 2400 | 11.4 | 303 | 1.68 | 357 to 1429 |
| ME-PHPs | Copper | 1200 to 4400 | 17 | 117 | 8.09 | 148 to 544 |

Notes: A.) Please note that in the table above the CTEs, thermal conductivities and moduli for composites reinforced with continuous fibers are inplane isotropic values. B.) The composite properties depend on reinforcement volume fractions of which typical ranges are shown above. Data is based upon limited information. C.) Intermetallics can be created between the reinforcement and matrix. This could possibly lead to hysteresis and/or thermal impedance beyond what is shown. D.) The ME-PHP numbers are projected.

The channel shapes described within are cylindrical in configuration. There are no restrictions on the channel shapes just as long as surface tensions can be achieved between the fluid and the channel to a degree that the surface tension allows for the distribution and maintenance of the fluid within the micro-channels via capillary action. This means that the channels can be oval in shape, possibly square, v-shaped or other.

The present channels and channel shapes shown in FIGS. 2, 3, 5A-C, 6A-B, 7, 8, 9, 10*a-c* and 11 can be contrasted with known channels in known thermal devices. For example, U.S. Pat. No. 6,679,316 to Lin et al. discloses a passive thermal spreader with wire-equipped channels that rely on a wire within the channel to return condensing or condensed liquid from a condenser region to an evaporator region. However, in the present heat pipe the channels and channel shapes do not rely on a wire within the channel to return condensing or condensed liquid from the condenser region to the evaporator region. Thus, in contrast to the known wire-equipped channels, at least the embodiments of the present device shown in FIGS. 2, 3, 5A-C, 6A-B, 7, 8, 9, 10*a-c* and 11 have wire-free channels. A wire-free channel is defined herein as a channel that does not have a wire within the channel.

In our background description, we described the channels as being produced via chem milling or by photo etching. They can also be created by machining, scratching, broaching, EDMing or any means necessary to create an internal cavity.

In a number of the present examples, the heat transfer devices are explained as used for space-based inventions. It is also contemplated that the present embodiments have a number of additional applications in microelectronics, optics, instrumentation, and other applications where temperature regulation is desired.

What is claimed is:

1. A micro-channel embedded heat pipe comprising:

a first sheet having a first serpentine trace pattern;

a second sheet bonded onto said first sheet, said second sheet having a second serpentine trace pattern substantially matching said first serpentine trace pattern such that when said first sheet and said second sheet are bonded together to form a bonded sheet, a wire-free serpentine micro-channel is formed in said bonded sheet; and at least one fill tube on at least one edge of the bonded sheet, allowing introduction of a fluid into said wire-free serpentine micro-channel;

wherein said wire-free serpentine micro-channel has a first end region having an evaporator region and has an opposed second end region having a condenser region.

2. The micro-channel embedded heat pipe of claim 1, further including:

a liquid, contained within said wire-free serpentine micro-channel and partially filling said wire-free serpentine micro-channel; and said wire-free serpentine micro-channel having a portion that is evacuated to at least a partial vacuum.

3. The micro-channel embedded heat pipe of claim 1, wherein said wire-free serpentine micro-channel has said evaporator region and said condenser region each including a respective plurality of bends of said wire-free serpentine micro-channel.

4. The micro-channel embedded heat pipe of claim 1, further comprising a working fluid introduced into said wire-free serpentine micro-channel, wherein said wire-free serpentine micro-channel spanning between said condenser region and said evaporator region is sealed after partially filling said wire-free serpentine micro-channel with said working fluid wherein no active fluid driver is in fluid communication with said working fluid.

5. A micro-channel embedded heat pipe comprising:

a planar substrate;

a wire-free serpentine micro-channel embedded within said planar substrate;

a working fluid that partially fills said wire-free serpentine micro-channel;

at least one evaporation region, on said planar substrate, the at least one evaporation region including a plurality of bends of said wire-free serpentine micro-channel; and at least one condensation region on said planar substrate.

6. The micro-channel embedded heat pipe of claim 5, further comprising:

a plurality of stacked planar substrates, including said planar substrate, each of said planar substrates having a respective serpentine micro-channel embedded therewithin;

said at least one evaporation region being included on said plurality of stacked planar substrates; and said at least one condensation region being included on said plurality of stacked planar substrates.

7. The micro-channel embedded heat pump of claim 5, wherein at least one evaporation transfer region includes a plurality of evaporation thermal transfer regions.

8. The micro-channel embedded heat pump of claim 5, wherein at least one condensation transfer region includes a plurality of condensation thermal transfer regions.

9. The micro-channel embedded heat pump of claim 5, wherein said planar substrate is incorporated into a structural element.

10. The micro-channel embedded heat pump of claim 5, wherein the serpentine channels may vary in diameter size allowing the regulation of flow.

11. The micro-channel embedded heat pipe of claim 5, further comprising a fill tube, wherein:

said wire-free serpentine micro-channel embedded within said planar substrate has said working fluid introduced by said fill tube positioned to allow said working fluid to be introduced into said wire-free serpentine micro-channel to partially fill said wire-free serpentine micro-channel; and an unfilled region of said wire-free serpentine micro-channel is evacuated to a vacuum.

12. The micro-channel embedded heat pump of claim 5, wherein said planar substrate includes two metallurgically joined sheets of material.

13. The micro-channel embedded heat pump of claim 5, wherein said micro-channel includes a first plurality of micro-channel sections having a relatively larger cross-sectional area, and a second plurality of micro-channel sections having relatively small cross-sectional areas.

* * * * *